US009157250B2

(12) United States Patent
Alammari

(10) Patent No.: US 9,157,250 B2
(45) Date of Patent: Oct. 13, 2015

(54) SWIMMING POOL SAFETY APPARATUS AND METHOD

(76) Inventor: Fahad M. Alammari, Bristol, RI (US)

( * ) Notice: Subject to any disclaimer, the term of this patent is extended or adjusted under 35 U.S.C. 154(b) by 675 days.

(21) Appl. No.: 13/447,719

(22) Filed: Apr. 16, 2012

(65) Prior Publication Data

US 2013/0269097 A1 Oct. 17, 2013

(51) Int. Cl.
*E04H 4/00* (2006.01)
*E04H 4/06* (2006.01)

(52) U.S. Cl.
CPC ..... *E04H 4/065* (2013.01)

(58) Field of Classification Search
USPC ..... 4/496, 498, 495; 340/573.1, 573.6
See application file for complete search history.

(56) References Cited

U.S. PATENT DOCUMENTS

| | | | | |
|---|---|---|---|---|
| 1,091,909 | A | | 3/1914 | Birmingham |
| 2,970,320 | A | | 2/1961 | Karp |
| 3,045,253 | A | | 7/1962 | Price |
| 3,052,893 | A | | 9/1962 | McClure |
| 3,435,465 | A | | 4/1969 | Formel |
| 3,668,711 | A | | 6/1972 | Liermann et al. |
| 3,955,797 | A | | 5/1976 | Richards |
| 4,106,134 | A | | 8/1978 | Schiron et al. |
| 4,129,905 | A | | 12/1978 | Niemirow |
| 4,747,168 | A | | 5/1988 | Sing |
| 4,831,672 | A | | 5/1989 | Niimura |
| 4,907,674 | A | | 3/1990 | Miller |
| 4,937,896 | A | | 7/1990 | Niimura |
| 5,025,512 | A | | 6/1991 | Niimura |
| 5,091,714 | A | | 2/1992 | de Solminihac |
| 5,267,358 | A | | 12/1993 | Roy et al. |
| 5,381,634 | A | * | 1/1995 | Pietrogrande et al. ..... 52/86 |
| 5,408,222 | A | | 4/1995 | Yaffe et al. |
| 5,678,253 | A | | 10/1997 | Baker |
| 5,832,547 | A | * | 11/1998 | Burroughs ..... 4/504 |
| 6,127,930 | A | | 10/2000 | Steffanus |
| 6,157,304 | A | * | 12/2000 | Bennett et al. ..... 340/573.6 |
| 6,253,390 | B1 | | 7/2001 | Laks |
| 6,389,615 | B2 | * | 5/2002 | Perrier ..... 4/495 |
| 6,493,885 | B2 | | 12/2002 | Perrier |
| 6,574,804 | B1 | | 6/2003 | Boujon |
| 6,640,504 | B2 | * | 11/2003 | Pearlson et al. ..... 52/66 |
| 7,479,891 | B2 | | 1/2009 | Boujon |
| 2007/0220667 | A1 | | 9/2007 | Kanetis |
| 2007/0256228 | A1 | | 11/2007 | Nexon |
| 2009/0126096 | A1 | | 5/2009 | Bocos |
| 2009/0235446 | A1 | | 9/2009 | Juracek |
| 2011/0209281 | A1 | | 9/2011 | Brock |
| 2012/0017365 | A1 | | 1/2012 | Perrier et al. |

FOREIGN PATENT DOCUMENTS

| | | |
|---|---|---|
| JP | 2007-63766 | 3/2007 |
| WO | WO 00/06856 | 2/2000 |

* cited by examiner

*Primary Examiner* — Lauren Crane
(74) *Attorney, Agent, or Firm* — Oblon, McClelland, Maier & Neustadt, L.L.P.

(57) ABSTRACT

A swimming pool safety system, and method, uses a preservation mechanism that lifts a human-sized object from within a swimming pool to a top surface of the swimming pool. An underwater detection array detects the human-sized object within the swimming pool and generates a detection data. A preservation controller actuates the preservation mechanism in response to an automatic actuation signal that was generated based on the detection data so as to actuate the preservation mechanism to lift the human-sized object above the top surface of the swimming pool.

18 Claims, 15 Drawing Sheets

| Physical Characteristic Class | Depth Threshhold (feet) | Threshold Duration (seconds) | Rate of Ascent | Ascent Adjestment | Audible Alarm |
|---|---|---|---|---|---|
| Infant | 0 | 1 | Maximum | No | Yes |
| Toddler | 3 | 3 | Maximum | No | Yes |
| Child | 8 | 5 | High | No | Yes |
| Teenager | 10 | 10 | Moderate | Yes | Yes |
| Adult | 10 | 15 | Low | Yes | No |

Figure 8

SWIMMING POOL SAFETY APPARATUS AND METHOD

GRANT OF NON-EXCLUSIVE RIGHT

This application was prepared with financial support from the Saudi Arabian Cultural Mission, and in consideration therefore the present inventor(s) has granted The Kingdom of Saudi Arabia a non-exclusive right to practice the present invention.

BACKGROUND

1. Field of the Disclosure

Embodiments described herein relate generally to a swimming pool safety system and method. More particularly, the embodiments described herein relate generally to a preservation mechanism for lifting a human-sized object to the top of a swimming pool, an underwater detection array that senses and detects a human-sized object within a swimming pool, and a preservation controller that actuates the preservation mechanism based on an analysis of inputs from both the underwater detection array an a user.

2. Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

The common enjoyment of the recreational facilities associated with outdoor or in-ground swimming is well recognized. One serious problem associated with the increased availability of domestic swimming pools, however, is an attendant danger for infants and small children as well as other individuals that are not proficient at swimming. The danger of inadvertent drowning is increased, at least to some extent, by the fact that most domestic swimming pools are easily accessible even when the property or area at which the pool is located is protected by some type of fence or like barrier.

As a result, various types of increased protection have been proposed. Such increased protection can take the form of a pool bottom platform or device that lifts a swimmer out of the water. The disadvantages, as recognized by the present inventor, of the current pool bottom platforms and safety devices lie in the means in which they are actuated. Many require manual activation while others only provide rudimentary detection mechanisms outside of the pool in order to actuate the pool bottom platform or safety device. There are limited pool safety devices that provide a useful amount of underwater safety detection within the swimming pool itself.

There exists a need, as recognized by the present inventor, to have a pool safety system that not only lifts an object out of the water but also be able to provide advanced detection capability that can recognize different situations or scenarios of underwater events and take distinct and appropriate actions based on the parameters of those underwater scenarios.

SUMMARY

The present invention is directed to a swimming pool safety system and method.

According to an embodiment of the present disclosure, the swimming pool safety system includes a preservation mechanism configured to lift a human-sized object from any point within a designated area of a swimming pool to the top surface of the swimming pool, an underwater detection array configured to detect a human-sized object at any point within a swimming pool as well as generate an appropriate detection data corresponding to the activity of the human-sized object, and a preservation controller configured to actuate the preservation mechanism in response to an actuation signal that was generated based on the detection data so as to actuate the preservation mechanism to lift the human-sized object to the top surface of the swimming pool.

According to a method embodiment, there is also provided a process of generating a detection data when a human-size object enters a swimming pool, generating a scenario based on the detection data, comparing the scenario to a set of predefined scenarios, and actuating a preservation mechanism so as to lift the pool bottom platform above the top surface of the swimming pool if the scenario matches any one of the set of predefined scenarios.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 8 show a user defined set of scenarios.

DETAILED DESCRIPTION OF THE EMBODIMENTS

Figure 1:
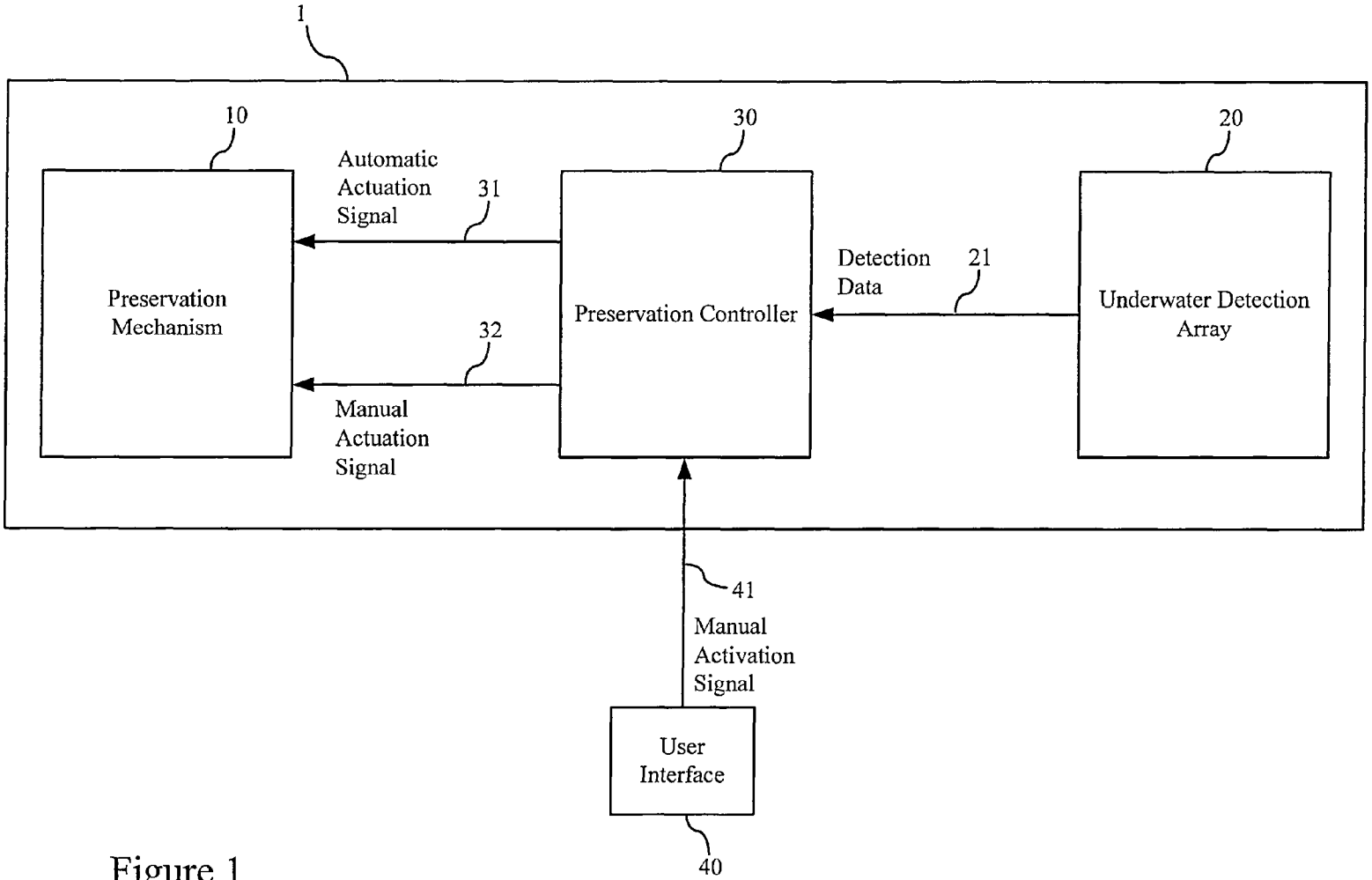
FIG. 1 is a system level view of an exemplary pool safety system.

While this disclosure may suggest many varied embodiments, there is shown in the drawings and will herein be described in detail specific exemplary embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

An exemplary system level view of a swimming pool safety system 1 shown in FIG. 1 provides a preservation mechanism 10 that physically lifts a human-sized object to the top surface of a swimming pool in response to a received actuation signal. An underwater detection array 20 with a plurality of underwater sensors detects objects within the swimming pool and determines the activity of said objects. A preservation controller 30 provides actuation signals to the preservation mechanism 10 based on inputs by either the underwater detection array 20 or a user interface 40.

The preservation mechanism 10 is the physical apparatus that provides the lifting force and the support structure in order to lift the human-sized object to the top surface of the swimming pool. The preservation mechanism 10 includes, but is not limited to, a plurality of lifting mechanisms to provide the motive force, a pool bottom platform which catches the human-sized object as the pool bottom platform is being lifted, and a plurality of vertical support structures which connect the pool bottom platform to the lifting mechanisms. A section view of the preservation mechanism 10, and all the components contained therein, along with its interface connection to the preservation controller 30 is presented in FIG. 2. The inside view and plan view of the preservation mechanism 10, and all the components contained therein, is presented in FIGS. 3 and 4 respectively.

The preservation controller 30 is configured to generate either an automatic actuation signal 31 or a manual actuation signal 32. The automatic actuation signal 31 is generated when a detection data 21 indicates that an unsafe situation is present within the swimming pool as determined by the preservation controller 30. The manual actuation signal 32 is generated via the preservation controller 30 when a user interface 40 initiates a manual activation signal 41.

Figure 2:
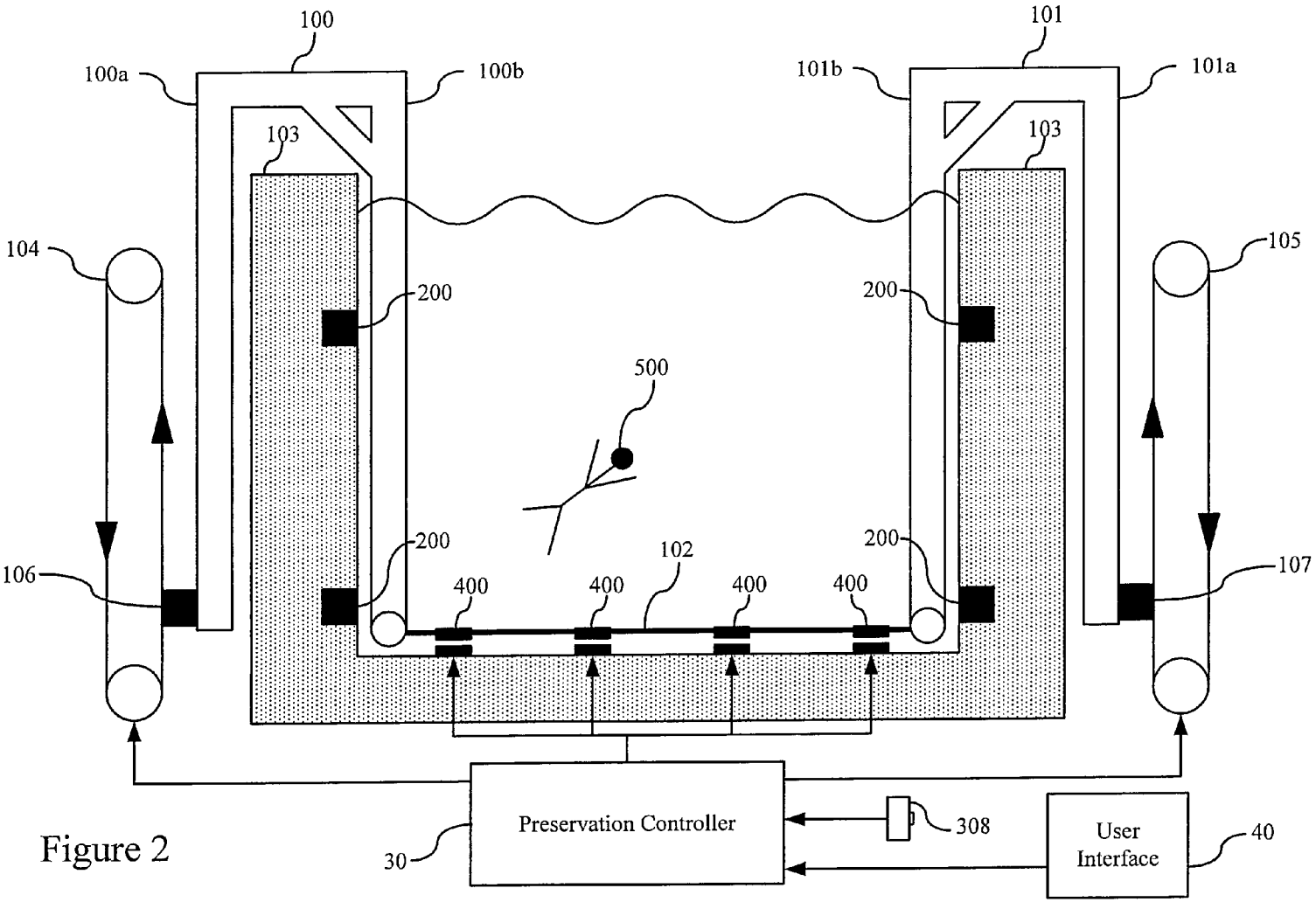
FIG. 2 is a physical side view of an exemplary pool safety system.
Figure 3:
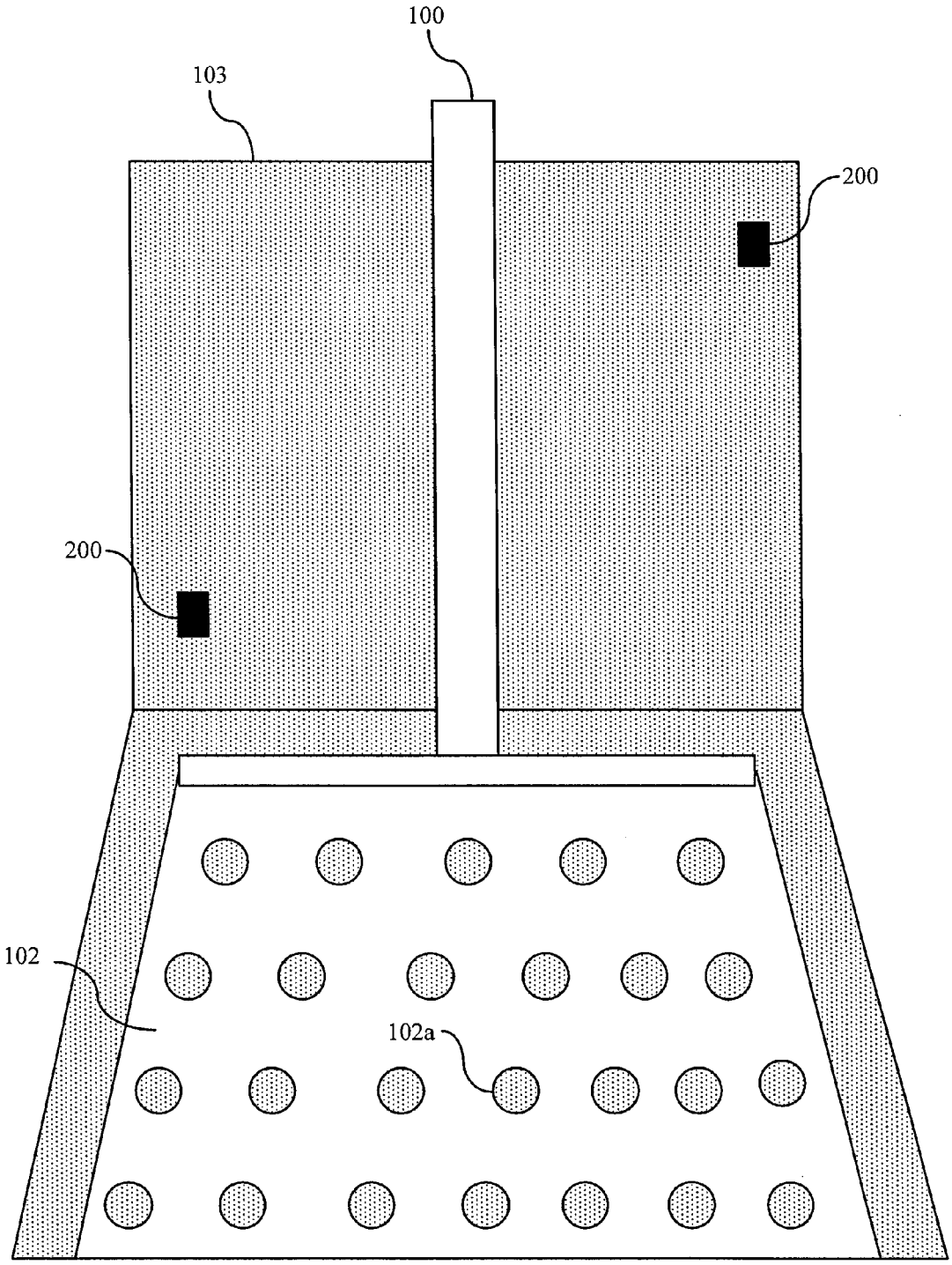
FIG. 3 is an inside view of an exemplary preservation mechanism.
Figure 4:
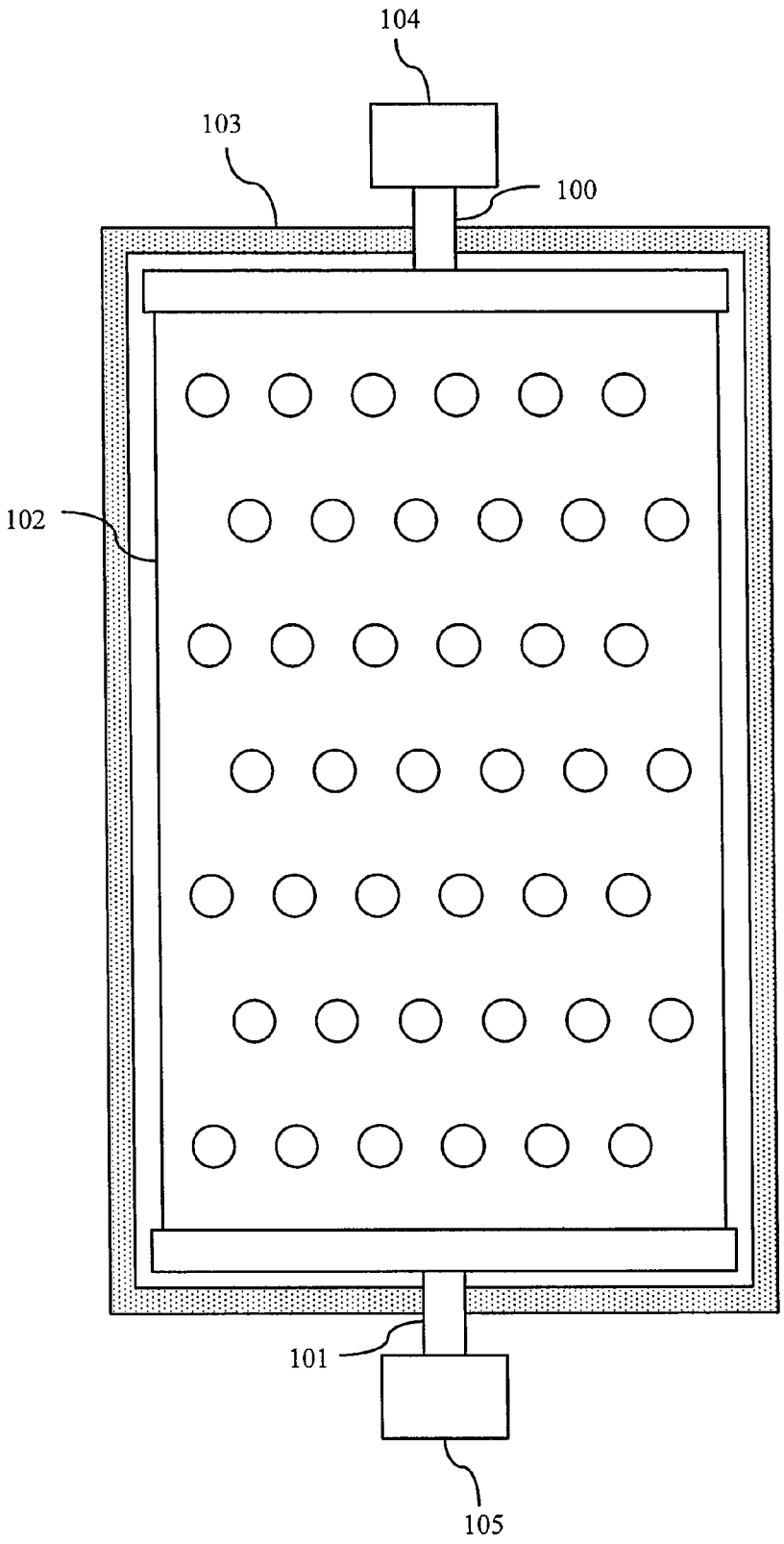
FIG. 4 is a top down view of an exemplary preservation mechanism.

In the embodiment of FIGS. 2-4, the preservation mechanism 10 includes a first vertical structure 100 and a second vertical structure 101. The first vertical structure 100 has a first upper section 100*a* and a first lower section 100*b*. The second vertical structure 101 has a second upper section 101*a* and a second lower section 101*b*. A pool bottom platform 102 that spans the bottom of a rectangular swimming pool 103 is connected at opposite ends to the first lower section 100*b* and the second lower section 101*b*. The first upper section 100*a* of the first vertical structure 100 is coupled to a first lifting mechanism 104 via a first coupling device 106. The second upper section 101*a* of the second vertical structure 101 is coupled to a second lifting mechanism 105 via a second coupling device 107. The coupling device can be any form of linear actuator which transfers motive force including, but not limited to, a rack and pinion apparatus, pulley system, belt drive, expansion cylinder or the like. When an actuation signal is received from the preservation controller 30, the first lifting mechanism 104 and the second lifting mechanism 105 respectively apply a motive force upon the first vertical structure 100 via the first coupling device 106 and the second vertical structure 101 via the second coupling device 107 in order to lift the vertical structures along with the attached pool bottom platform 102 to the top surface of the swimming pool 103. The motive force of the lifting mechanisms can be mechanical, electrical, magnetic, hydraulic, pneumatic, buoyant, or restorative in nature.

Within the swimming pool, there is also an array of a plurality of underwater detection sensors 200 which detects activity within the swimming pool 103 environment. The underwater detection sensors 200 are tuned to detect human-sized objects of various sizes within the swimming pool 103. The dimension of a human-size object can range from those of an infant to that of a fully grown adult. The underwater detection sensors 200 are optical sensors but could be any underwater capable detection device that senses human-sized objects such as acoustic, laser, IR, optical sensing devices or any combination thereof.

When a human-sized object is detected within the swimming pool 103, detection data from each of the underwater detection sensors 200 is sent to the preservation controller 30 for processing. While the exemplary pool safety apparatus presented in FIG. 2 show two sensors at either end of the swimming pool 104, for a total of four sensors, any sensor configuration can be applied with any number of sensors such as 8, 12, or 16. A more expansive sensor configuration with numerous sensors may be warranted if additional accuracy and safety are a concern, such as a scenario in which several young children are using the swimming pool 103. The more underwater detection sensors 200 that are located within the swimming pool 103, the more accurate the detection and thus the more responsive the swimming pool safety system 1 will be in any given scenario.

Figure 5:
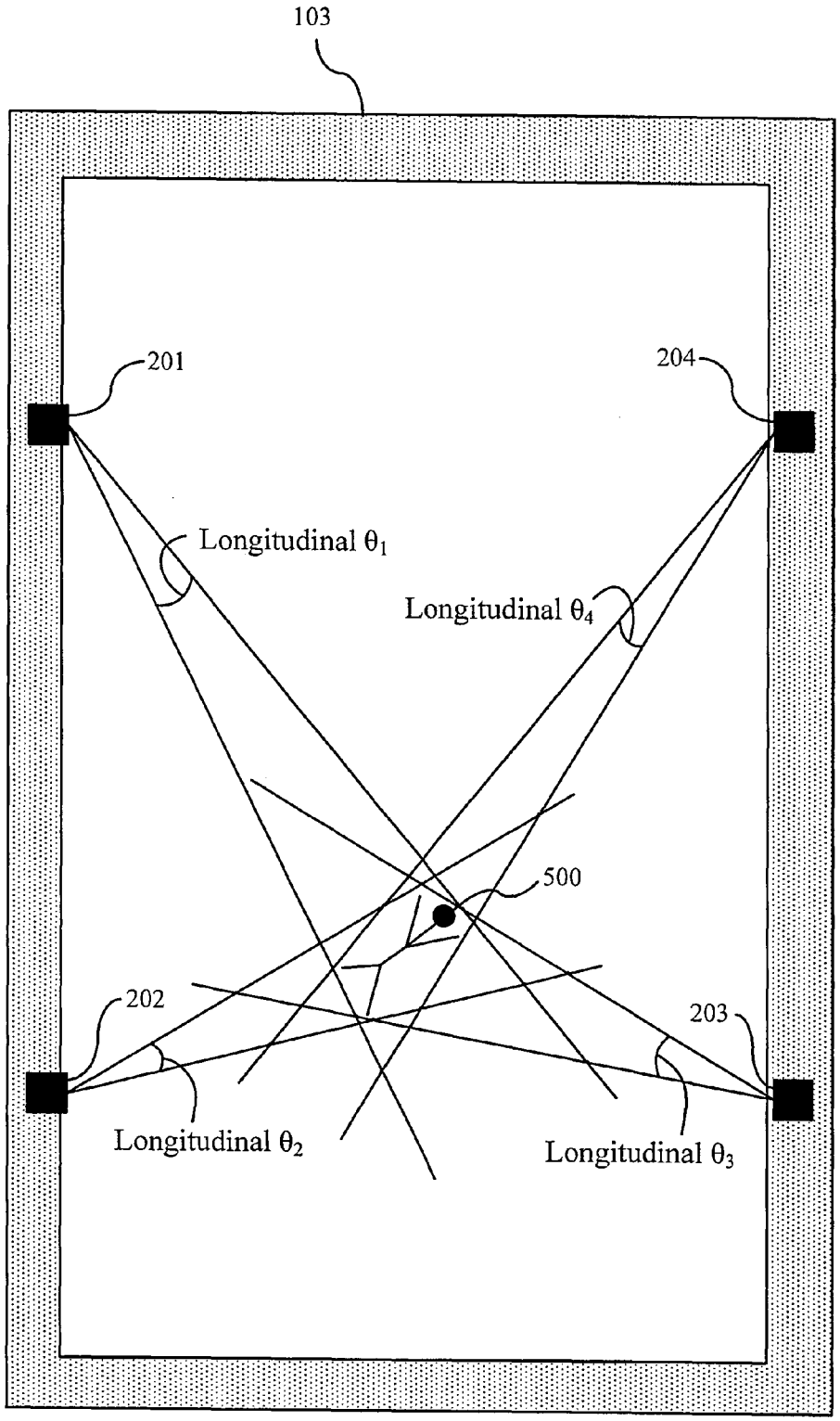
FIG. 5 is a top down representation of an exemplary underwater detection array.
Figure 6:
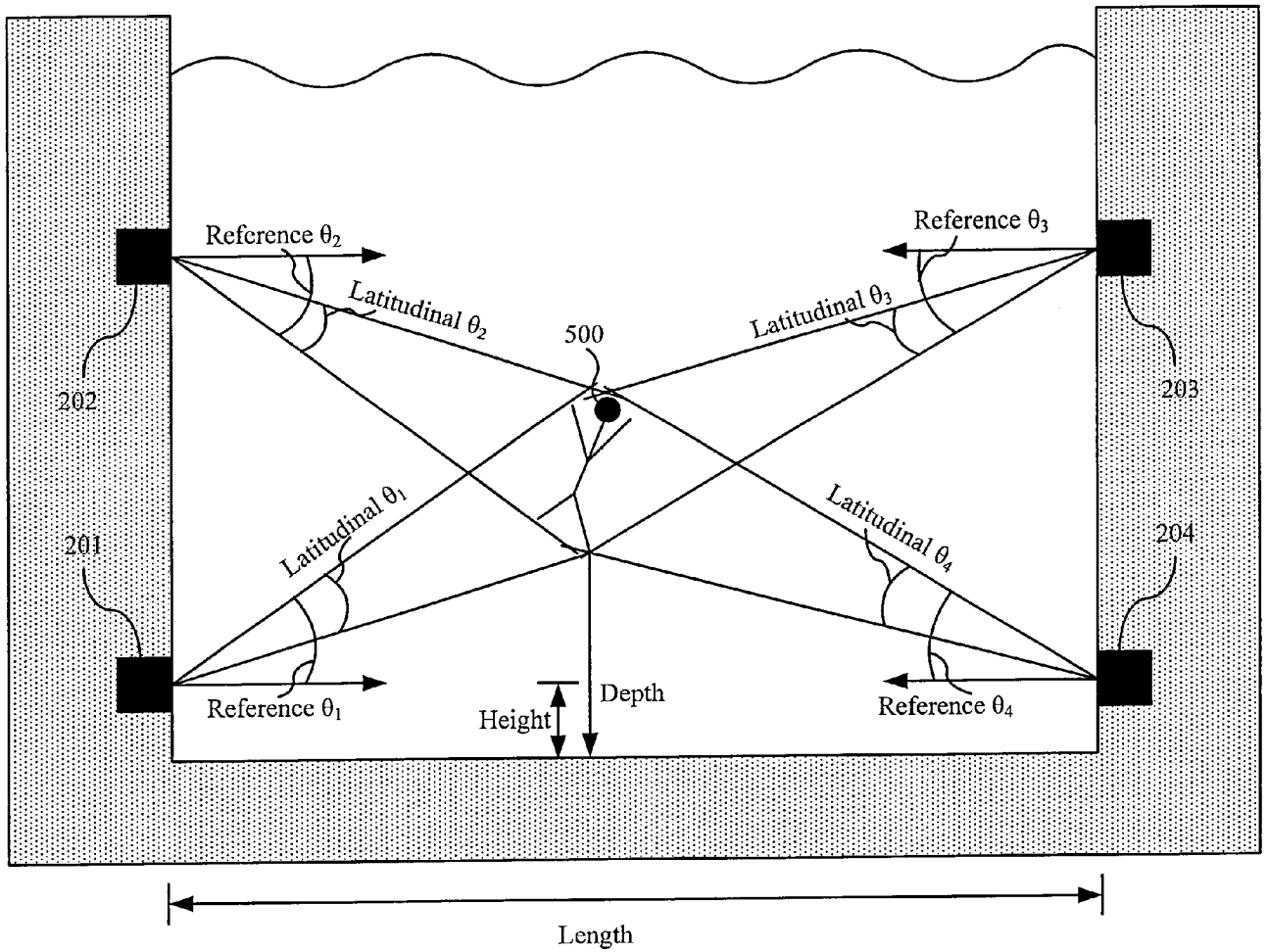
FIG. 6 is a side view representation of an exemplary underwater detection array.

An exemplary detection of a human-sized object is presented in FIGS. 5 and 6 where an array of four underwater detection sensors 200 has detected a human-sized object is within the swimming pool 103. Upon detection of the human-sized object within the swimming pool 103, each underwater detection sensor 200 determines a latitudinal angle, longitudinal angle, range, and depth data. The detection of the object within the sensor field of view is done through a pattern match of the CCD sensor pixel values to a standard grey scale. Pixel values representing darker than the standard value detect a match. Therefore, if the CCD detection matrix is arranged in a square matrix, and pixels in the lower left quadrant of the matrix have values lower (darker) than the standard value, then the object is detected as being in the lower left quadrant of the sensor field of view. The resolution of the sensors are determined by the number of sensing elements and the pool area covered by each element.

The top down view of the swimming pool 103 in FIG. 5 is an overhead diagram of the swimming pool 103 with each underwater detection sensor 200 illustrated with its respective longitudinal angle of the object within the respective sensor's field of view.

The cross sectional view of the swimming pool 103 in FIG. 6 shows each underwater detection sensor 200 generating a respective latitudinal angle. Each underwater detection sensor 200 also has a reference angle that is referenced from the perpendicular plane of the underwater detection sensor 200. With the latitudinal angle, longitudinal angle, and reference angle information for a human-sized object 500 generated by each underwater detection sensor 200, a specific location and depth data can be calculated by the preservation controller 30. One manner in which depth can be determined by the preservation controller 30 is via a triangulation algorithm in conjunction with the known placements of the underwater detection sensors 200. In the case presented in FIG. 6, the height of the underwater detection sensors 201 and 204 above the bottom of the floor of the swimming pool 103 are known as well as the separation length of underwater detection sensors 201 and 204 across the swimming pool 103. The depth of the deepest part of the human-sized object within the swimming pool 103 can be calculated using the following equitation:

$$\text{Depth} = \frac{(\text{Length}) \times \sin(\text{ref}\theta_1 - \text{lat}\theta_1) \times \sin(\text{ref}\theta_2 - \text{lat}\theta_2)}{\sin[(\text{ref}\theta_1 - \text{lat}\theta_1) + (\text{ref}\theta_2 - \text{lat}\theta_2)]} + \text{Height}$$

where Length is the distance between underwater detection sensor 201 and underwater detection sensor 204 and Height is the distance of both underwater detection sensors 201 and 204 above the floor of the swimming pool 103. The physical dimensions of the human-sized object 500 are determined by combining the latitudinal angles with their respective longitudinal angles to generate a volume in which the dimensions of the human-size object can be approximated.

While the preceding example generates location and depth data for a human-size object 500 within an exemplary swimming pool, more complex algorithms can also be used based upon the accuracy and configuration desired.

Figure 7:
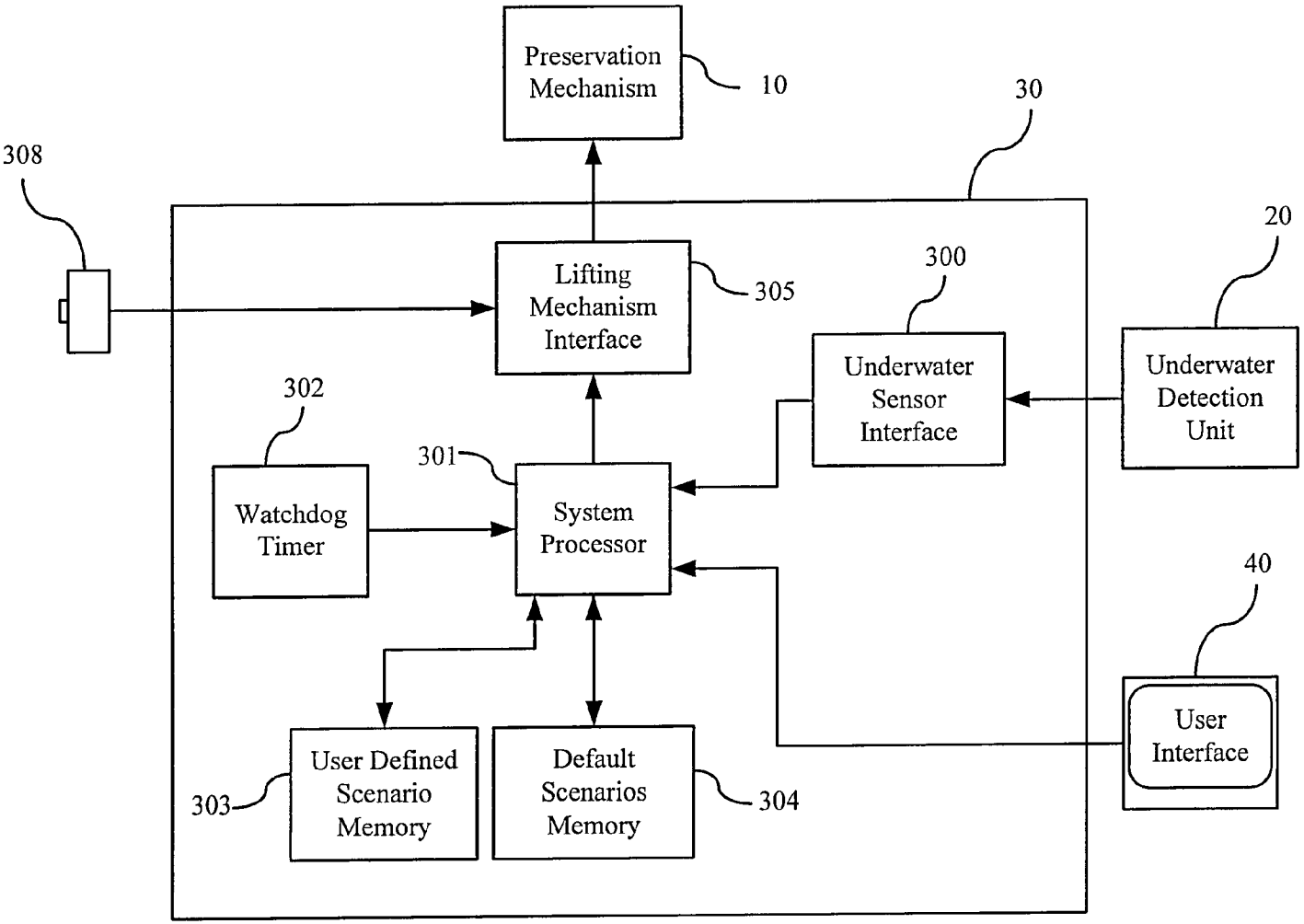
FIG. 7 is an exemplary preservation controller.

If detection data is being generated (i.e., the detection of a human-sized object with the swimming pool 103) by one or more of the underwater sensor units 200, the underwater detection array 20 sends detection data to the underwater sensor interface 300 within the preservation controller 30 as presented in FIG. 7. The underwater sensor interface 300 converts the detection data, which may be in one or more formats based on the type of underwater sensor unit 200 that made the detection. In the present example, the sensor provides latitudinal and longitudinal angles for the detected object. Such types of underwater detection arrays 200 could include acoustic, laser, motion, optical sensing devices or any combination thereof. The underwater sensor interface 300 converts the detection data into a digital format for processing by the system processor 301. The system processor 301 receives the detection data from the underwater sensor interface 300 and determines the size and location of the human-sized object within the swimming pool 103 using an algorithm such as the one previously discussed. Together with a timing input from a watchdog timer 302, a scenario of the current activity within the swimming pool 103 is generated. The system processor 301 compares the generated scenario to predefined scenarios within a user defined scenario memory 303 or a default scenario memory 304. If a scenario generated by the system processor 301 matches a predefined scenario contained within either the user defined scenario memory 303 or a default scenario memory 304, than an automatic actuation signal is generated based upon the parameters of the predefined scenario and is sent to the lifting mechanism interface 305 which then actuates the preservation mechanism 10.

A user can store or modify a user defined scenario to the user defined scenario memory 303 via the user interface 40. A user defined scenario can trigger an automatic actuation signal based on any number of user safety concerns such as, but not limited to, age, number, or swimming ability, of potential swimmers using the swimming pool 103. An exemplary list of scenarios that could be generated by the user interface 40 via the user interface 40 is shown in FIG. 8. The parameters that a user could enter or modify would include a depth threshold, a duration threshold, an ascension speed, an ascension adjustment parameter, and an audible alarm option.

An example of a first scenario may include a toddler that reaches a certain depth within the swimming pool 103 pool such as the pool bottom. Due to the physical limitations or the limited swimming ability of the child, a user may feel that if the child were to reach the bottom of the swimming pool 103, it would be an abnormal situation. The user would make an entry into the toddler class via the user interface 40 along with an appropriate threshold time such as three seconds at or below a first specified depth, in this case three feet. The remaining parameters would also be entered as desired. This scenario will then be stored within the user defined scenario memory 303 of the preservation controller 30. If a human-sized object that matched the physical dimensions of the toddler class were to exceed three feet in depth for more than three seconds, the preservation mechanism 10 would lift the toddler at maximum speed to the surface of the swimming pool 103 and trigger an audible alarm. The triggered alarm may also be in the form of a cellular phone text or the contact of an emergency number.

In a second scenario, all of the potential users of the swimming pool 103 may be teenagers who have proficient swimming abilities. Additional freedom may be desired within the swimming pool 103 so as to not needlessly trigger the preservation mechanism 10. In this scenario, a more extended stay at a certain depth may be an indication of an abnormal situation. In this case, the user would make an entry into the teenager class via the user interface 40 along with an appropriate threshold time such as ten seconds at or below a specified depth, in this case 10 feet. This scenario will then be stored within the user defined scenario memory 303 of the preservation controller 30.

User defined scenarios can also include parameters that can also adjust the speed at which a lifting mechanism actuates. One example in which this feature would be applied may include an inclined swimming pool that has a floor in which one side of the inclined swimming pool is a shallow side and one side of the inclined swimming pool is a deep side. If both lifting mechanisms actuate at the same speed, the pool bottom platform, initially in an inclined state along the swimming pool floor, will travel through the water at and angle with one side reaching the top of the swimming pool before the other. This can create a dangerous and undesirable situation. The user 40 has the option set a parameter within a user defined scenario so that in the case of an inclined swimming pool, the lifting mechanism on the shallow end will provide a smaller degree of motive force and thus travel at a slower speed than the lifting mechanism on the deep end of the inclined swimming pool. This allows the pool bottom platform to level out as it travels to the surface of the pool with both ends reaching the top of the swimming pool at the same time after an automatic actuation signal is generated.

A default set of defined scenarios may also be provided in the default scenario memory 304. The default scenarios can provide a general and conservative set of scenarios and can provide a backup to the user defined scenarios. Default scenarios can also be toggled on or off as needed by a user when they are neither required nor desired. This may be when there is sufficient supervision of younger swimmers or swimmers are deemed proficient enough to use the swimming pool 103 without a more conservative set of default scenarios in place. The user defined scenarios can also be toggled on or off if no automatic safety action at all is desired. In this case, a manual activation is still available via a manual activation button 308.

If a manual activation of the swimming pool safety system 1 is needed, a user can activate the manual activation button 308 to generate a manual actuation signal. When the manual activation button 308 has been activated, a manual actuation signal is sent directly to the lifting mechanism interface 305 which then actuates the lifting mechanisms in the preservation mechanism section 10. Since the manual activation is not based on any predefined scenario or set of parameters, the actuation of the lifting mechanisms in the preservation mechanism section 10 is completed an expeditiously as possible.

In another embodiment, there could exist a plurality of vertical structures and a plurality of associated lifting mechanisms based upon the configuration of the swimming pool. The swimming pool 103 in the exemplary embodiment is of a basic rectangular shape of uniform depth for simplicity of presentation. Typical swimming pools can take a plurality of forms with various shapes, sizes, and depths. In order to provide a safer swimming environment to any pool configuration using the present invention, a plurality of vertical structures and a plurality of associated lifting mechanisms can be implemented to achieve a safer swimming environment in all or part of a swimming pool in a plurality configurations.

Figure 9:
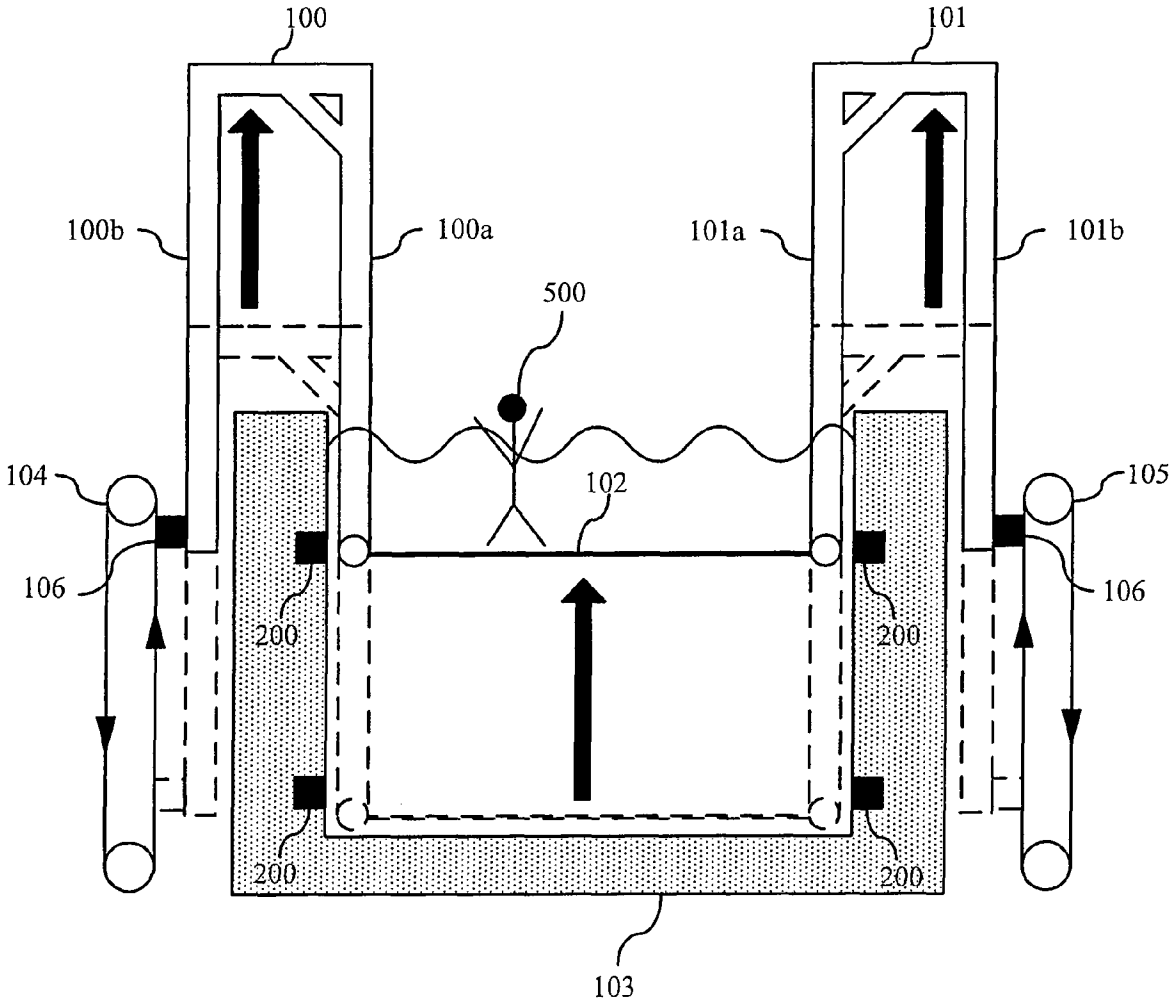
FIG. 9 is a preservation mechanism being actuated.

In another embodiment, the user can also interact with the preservation controller 30 via the user display 40 to manually change the level of the pool bottom platform 102 to various heights within the pool. Initially the pool bottom platform 102 may be located at a default location on the bottom of the swimming pool 103 for a normal swimming environment. If younger children or less proficient swimmers are using the pool, the pool bottom platform 102 may be raised via the user interface 40 to a desired level within the swimming pool 103 as shown in FIG. 9 in order to artificially change the depth of the swimming pool 103 and create a safer swimming environment.

Figure 10A:
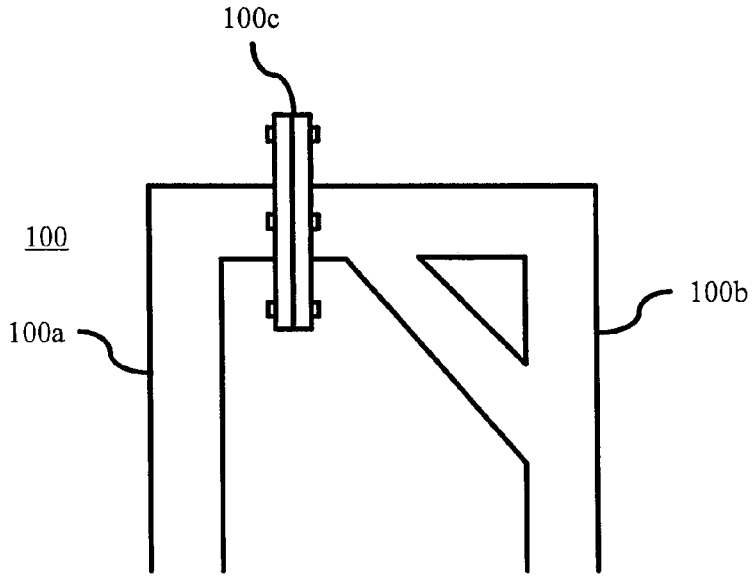
FIGS. 10A and 10B is a separable flange type connection.
Figure 10B:
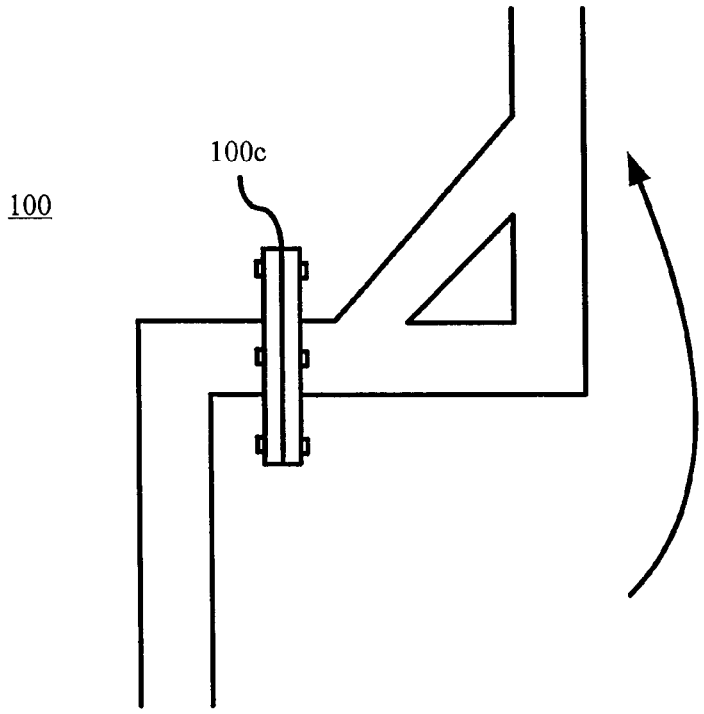
Figure 11:
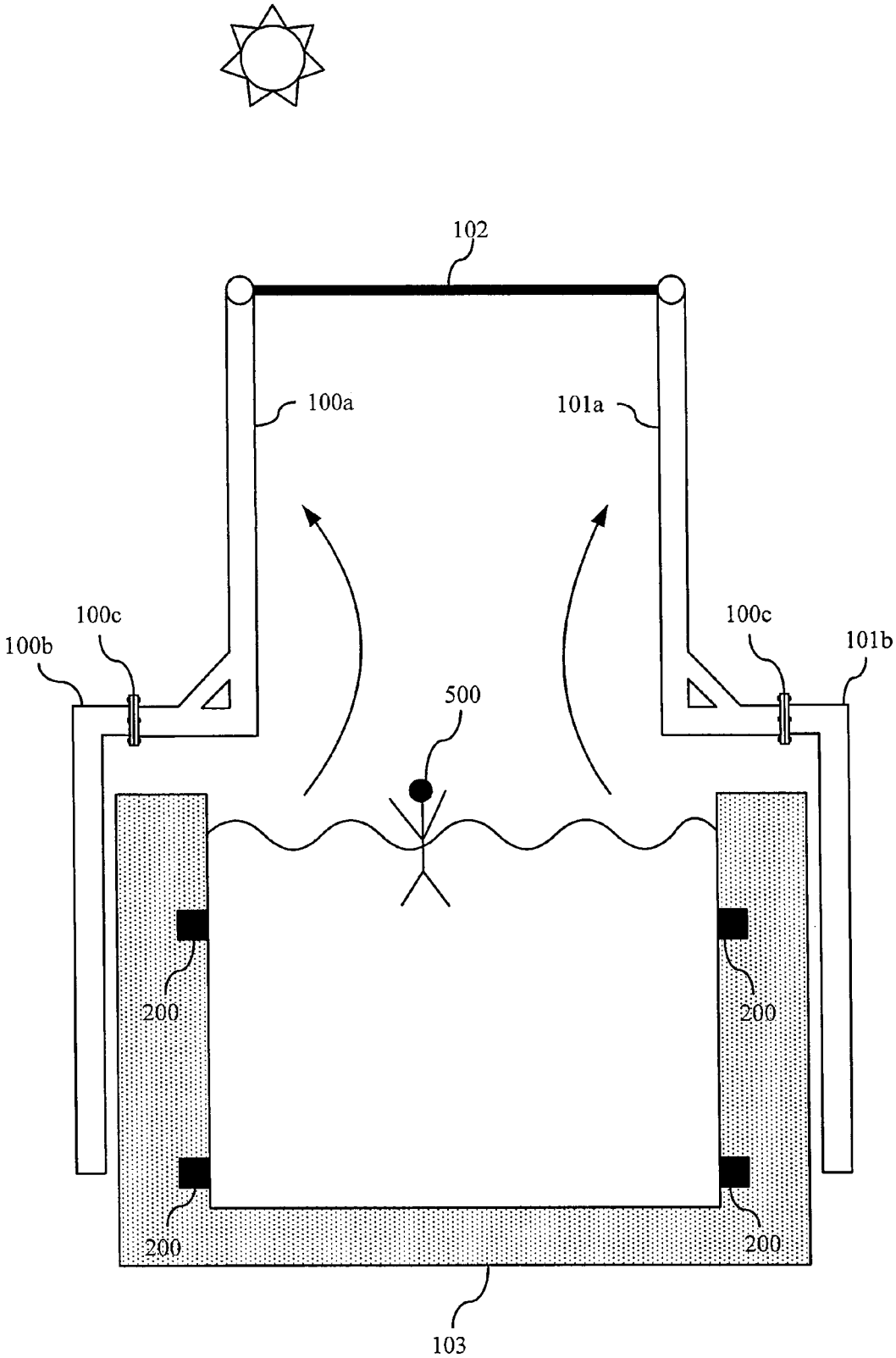
FIG. 11 is a preservation mechanism that has been rotated about a flange type connection.

In another embodiment, the vertical structures may contain a separable connection that facilitates the manual removal of the lower section of the vertical structure from the upper section of the same vertical structure. An example of this is shown in FIG. 10A where the connection 100*c* is a flange type connection that separates the upper section of the first vertical structure 100*a* from the lower section of the first vertical structure 100*b*. While a flange type connection is shown, any appropriate form of separable connection can be implemented. Purposes for the removal of the lower section of the first vertical structure 100*b* may include maintenance, replacement, or manual rotation of the pool bottom platform 102 by 180 degrees, as shown in FIG. 10B, so as to provide environmental protection for the swimming pool 103 as shown in FIG. 11.

In another embodiment, the separable connection may also have an electric motor device coupled that facilitates the automatic rotation of the lower section of a vertical structure about the upper section of a vertical structure. The electric motor device may be controlled through the preservation controller 30 via the user interface 40.

In another embodiment, a plurality of electromagnetic devices 400 may be placed along the pool floor with the a respective magnetic material attached to the pool bottom platform 102 in the preservation mechanism 10 as shown in FIG. 1. These electromagnetic devices 400 can serve two purposes. The first purpose would be to provide additional motive force to the pool bottom platform 102 after the preservation mechanism 10 has been actuated by the preservation controller 30. Due to the resistance of the water in the swimming pool 103 as well as the inertia of the pool bottom platform 102 initially at rest, a slow acceleration and subsequent velocity of the pool bottom platform 102 as it travels to the surface of the swimming pool 103 after being actuated may result. Activating the electronic devices 400 in parallel with the actuation signal will provide an additional motive force on top of that of the lifting mechanisms. This additional motive force will provide enhanced acceleration and travel velocity characteristics.

Figure 12:
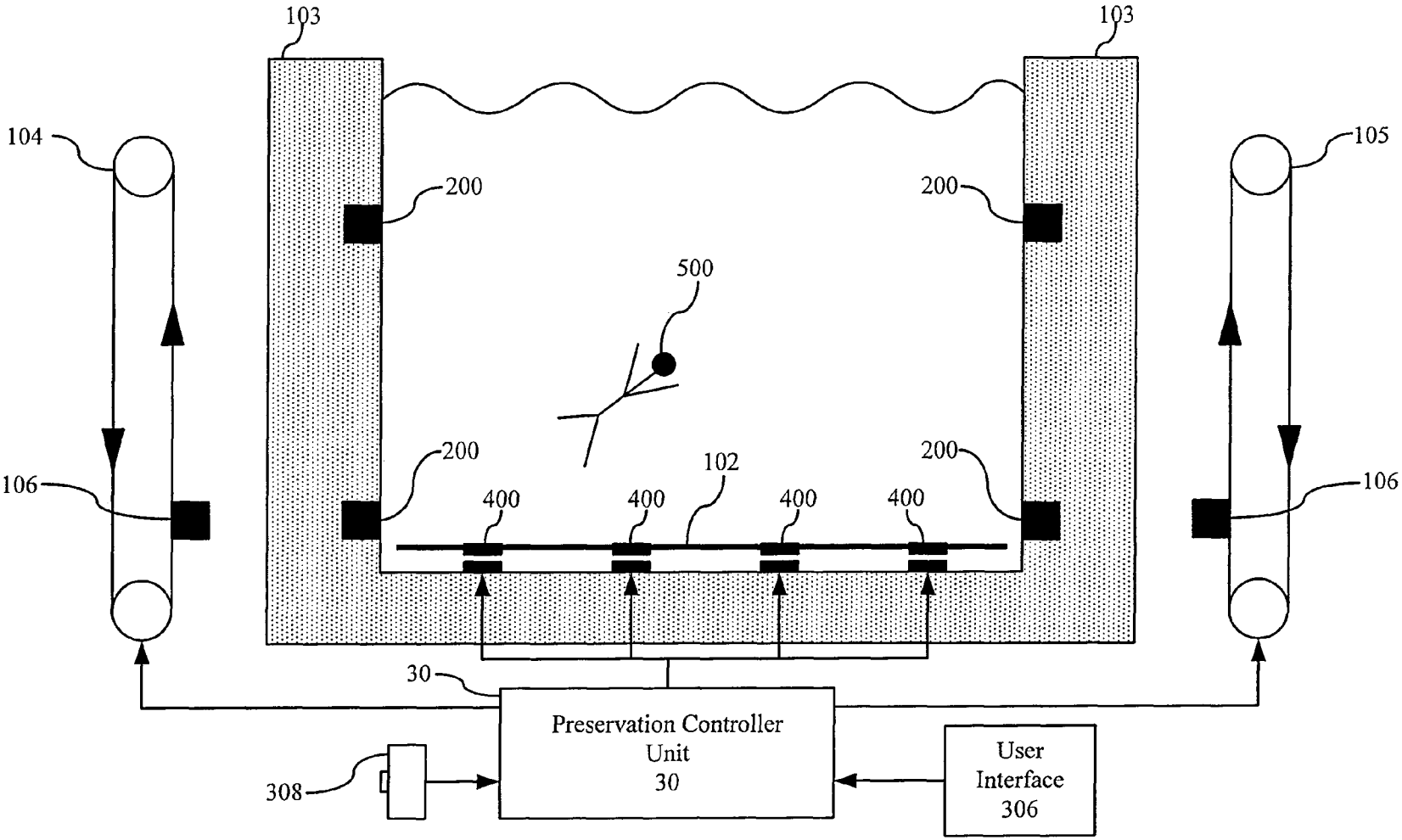
FIG. 12 is an alternate pool safety system using electromagnetic devices.

The second purpose of the plurality of electromagnetic devices 400 would be to replace the lifting mechanisms as a source of motive force for the preservation mechanism 10 as shown in FIG. 12. In this configuration, the vertical structures may be removed at their respective separable connection points. The vertical structures would also be removed from the pool bottom platform 102. The plurality of electromagnetic devices in combination with a pool bottom platform 102 that has buoyant properties would provide the safety mechanism. The plurality of electromagnetic devices would initially be set at an opposite polarity of that of their respective magnetic material counterpart on the buoyant pool bottom platform 102. The rest of the swimming pool safety system will act as normal. When an actuation signal is generated either from detection data from the underwater detection array 20 or from a manual actuation signal from the manual activation button 308, the preservation controller 30 would actuate the electromagnetic devices. This would reverse their polarity and provide a motive force via magnetic repulsion in combination with the buoyant force of the buoyant pool bottom platform 102. This magnetic repulsion along with the buoyant force of the buoyant pool bottom platform 102 would provide the initial acceleration and subsequent velocity for the buoyant pool bottom platform to be lifted to the top surface of the swimming pool 103. Alternatively, the electromagnetic devices 400 are turned off, so the buoyant pool bottom platform 102 raises naturally.

Figure 13:
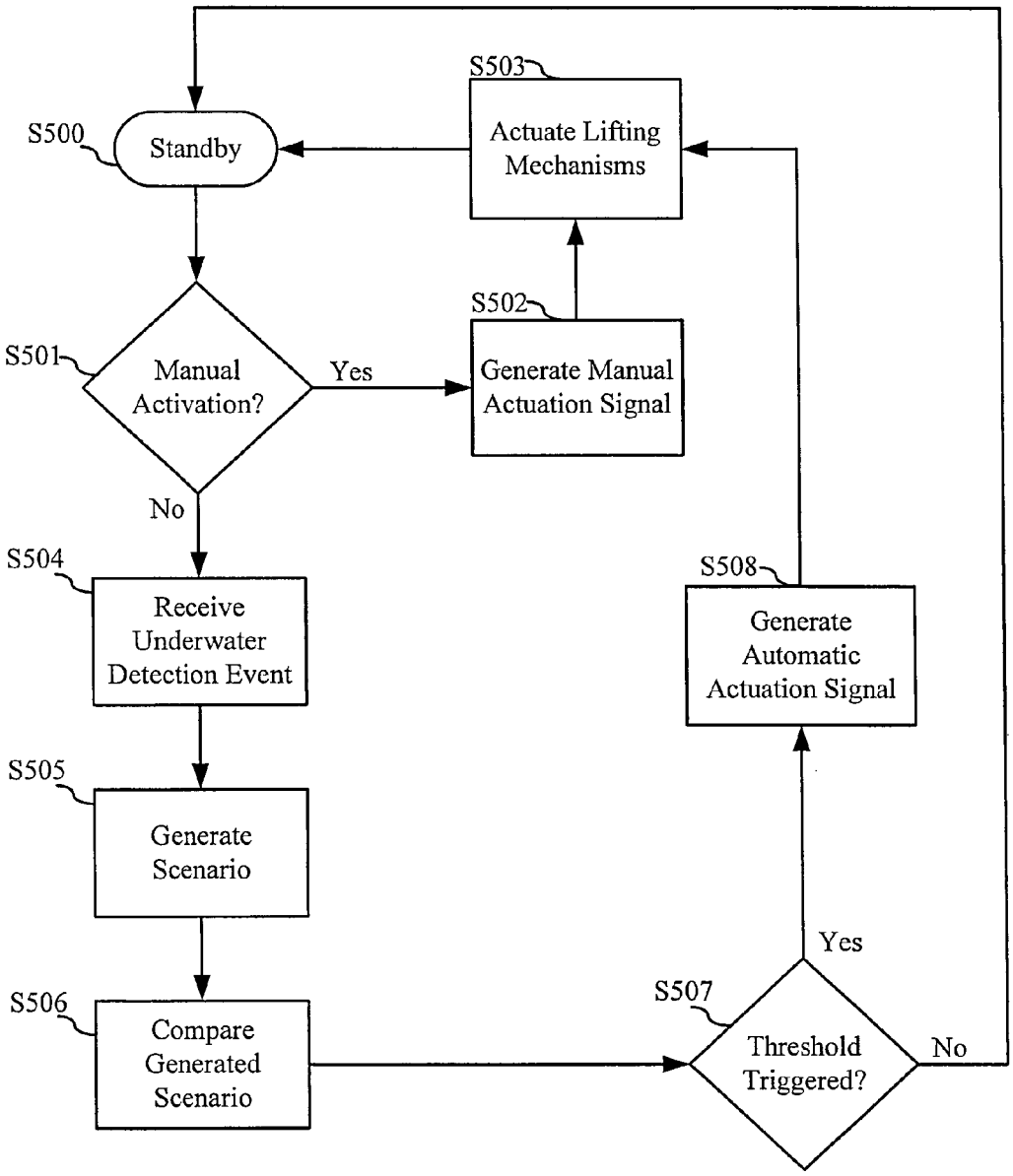
FIG. 13 is a flow diagram for an exemplary pool safety method.

An exemplary method of an activation of the swimming pool safety system 1 is presented in FIG. 13. Initially, the swimming pool safety system 1 is in a standby state at step S500 to actuate the lifting mechanism of the preservation mechanism section 10. When a signal is received by the preservation controller 30 at S501 it can either be detection data from the underwater detection array 20 or a manual actuation signal from the manual activation button 308. If the signal is a manual actuation signal, the preservation controller 30 initiates the manual actuation at S502. The lifting mechanism interface 305 actuates the lifting mechanisms at S503 within the preservation mechanism 10 in an expedited manner.

If the signal is detection data, the underwater sensor interface 300 converts the detection data signal at S504 into a digital format for processing by the system processor 310. The system processor 301 analyzes the detection data and along with a timing input from a watchdog timer 302, the detection data is processed over time at step S505 to generate a scenario that is representative of the activity currently within the swimming pool 103. The system processor compares the generated scenario in S506 to scenarios in both the user defined scenario memory 303 and the default scenario memory 304, if the default scenarios have been enabled. If the generated scenario exceeds a threshold contained within a user defined scenario or a default scenario in S507 stated in either of the user defined scenario memory 303 or the default scenario memory 304, the preservation controller 30 will generate an automatic actuation signal at S508. The lifting mechanism interface 305 actuates the lifting mechanisms at S503 within the preservation mechanism section 10. If the generated scenario does not exceed a threshold contained within a user defined scenario or a default scenario in S507 stated in either of the user defined scenario memory 303 or the default scenario memory 304, the system will continue to continue to generate scenarios of the activity within the swimming pool 103.

Figure 14:
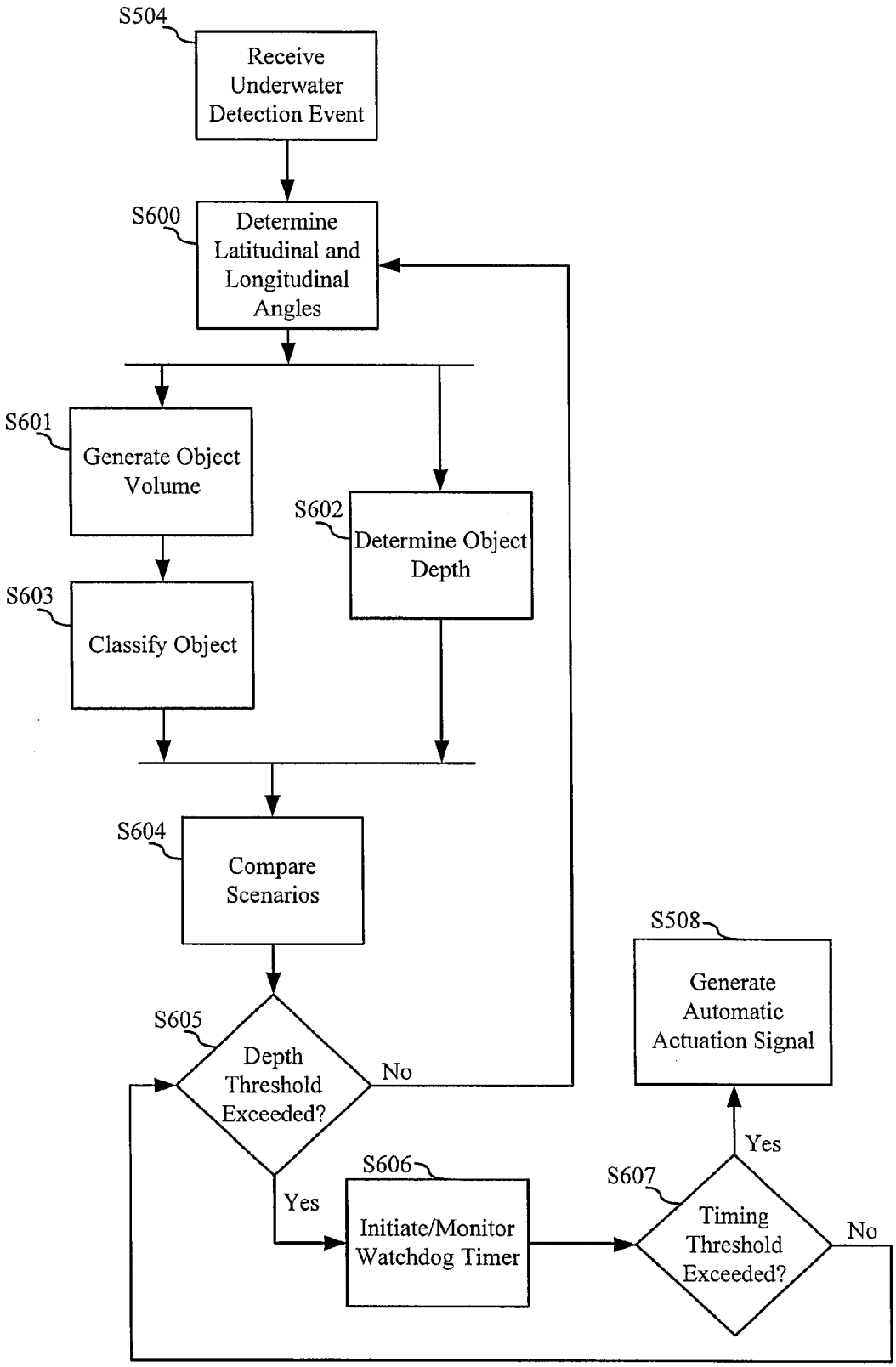
FIG. 14 is a flow diagram for an exemplary scenario generation method.

An exemplary method of generating scenarios within the preservation controller 30 is also presented in FIG. 14. The flowchart in FIG. 14 shows the functions of steps S505 through S507 presented in FIG. 13 in more granularity using the previously discussed example of determining the location and depth of a human-sized object 500 within a swimming pool 103. Once detection data from the underwater detection array 20 has been processed by the underwater sensor interface 300 at S504, the detection data is parsed at S600 to determine the latitudinal and longitudinal angles of each of the underwater detection sensors that have detected a human-sized object 500 within the swimming pool 103. Once the latitudinal and longitudinal angles have been determined at S600 this information is used to calculate the volume and the depth of the object at S601 and S602 respectively. Once the volume of the object has been determined at S601, the object volume is then used to classify the object at S603. The combination of object classification and depth represent a scenario of the current activity within the swimming pool 103. The generated scenario is then compared with both the user defined and default scenarios at S604. If the depth of the classified object in the swimming pool 103 exceeds the depth of that stated in a user defined or default scenario in S605, a watchdog timer is initiated at S606. Otherwise, the scenario is regenerated with updated information at S600. If the timing threshold of the user defined or default scenarios is exceeded at S607, an automatic actuation signal is generated at S508. If the timing threshold is not exceeded and the depth threshold is still exceeded, the watchdog timer will continue until the depth is reduced or the timing threshold is exceeded and an automatic actuation signal is generated.

Figure 15:
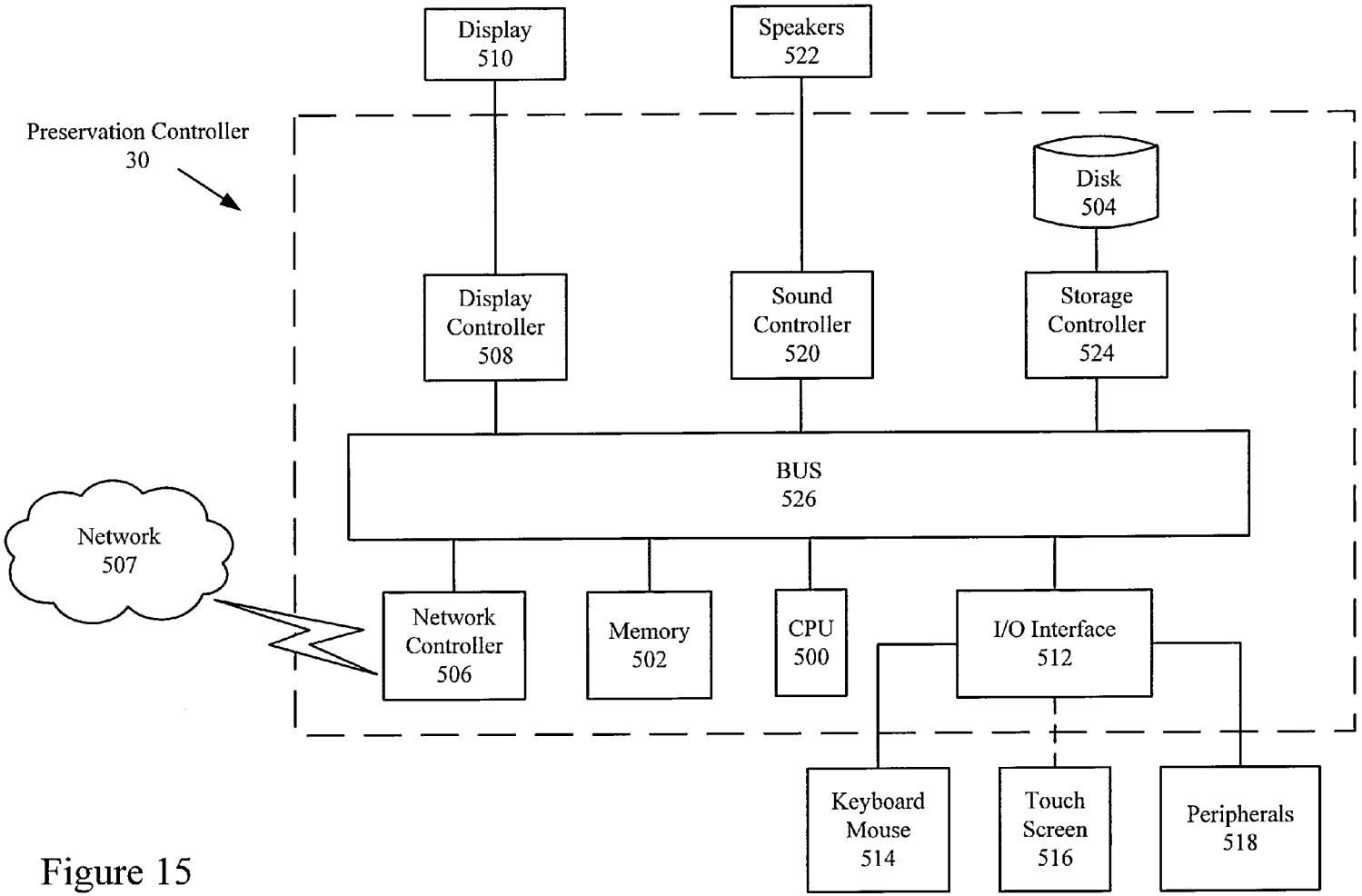
FIG. 15 is a hardware block diagram of an exemplary preservation controller.

Next, a hardware description of the preservation controller 30 according to exemplary embodiments is described with reference to FIG. 15. In FIG. 15, the preservation controller 30 includes a CPU 500 which performs the processes described above. The process data and instructions may be stored in memory 502. These processes and instructions may also be stored on a storage medium disk 504 such as a hard drive (HDD) or portable storage medium or may be stored remotely. Further, the claimed advancements are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the computer aided design station communicates, such as a server or computer.

Further, the claimed advancements may be provided as a utility application, background daemon, or component of an operating system, or combination thereof, executing in conjunction with CPU 500 and an operating system such as Microsoft Windows 7, UNIX, Solaris, LINUX, Apple MAC-OS and other systems known to those skilled in the art.

CPU 500 may be a Xenon or Core processor from Intel of America or an Opteron processor from AMD of America, or may be other processor types that would be recognized by one of ordinary skill in the art. Alternatively, the CPU 500 may be implemented on an FPGA, ASIC, PLD or using discrete logic circuits, as one of ordinary skill in the art would recognize. Further, CPU 500 may be implemented as multiple processors cooperatively working in parallel to perform the instructions of the inventive processes described above.

The preservation controller 30 in FIG. 15 also includes a network controller 506, such as an Intel Ethernet PRO network interface card from Intel Corporation of America, for interfacing with a wireless network 507. As can be appreciated, the wireless network 507 can be a public network, such as the Internet, or a private network such as an LAN or WAN network, or any combination thereof and can also include PSTN or ISDN sub-networks. The wireless network 507 can also be wired, such as an Ethernet network, or can be wireless such as a cellular network including EDGE, 3G and 4G wireless cellular systems. The wireless network can also be WiFi, Bluetooth, or any other wireless form of communication that is known.

The preservation controller 30 further includes a display controller 508, such as a NVIDIA GeForce GTX or Quadro graphics adaptor from NVIDIA Corporation of America for interfacing with display 510, such as a Hewlett Packard HPL2445w LCD monitor. A general purpose I/O interface 512 interfaces with a keyboard and/or mouse 514 as well as a touch screen panel 516 on or separate from display 510. General purpose I/O interface also connects to a variety of peripherals 518 including printers and scanners, such as an OfficeJet or DeskJet from Hewlett Packard.

A sound controller 520 is also provided in the preservation controller 30, such as Sound Blaster X-Fi Titanium from Creative, to interface with speakers/microphone 522 thereby providing sounds and/or music. The speakers/microphone 522 can also be used to accept dictated words as commands for controlling the preservation controller 30 or for providing location and/or property information with respect to the target property.

The general purpose storage controller 524 connects the storage medium disk 504 with communication bus 526, which may be an ISA, EISA, VESA, PCI, or similar, for interconnecting all of the components of the preservation controller 30. A description of the general features and functionality of the display 510, keyboard and/or mouse 514, as well as the display controller 508, storage controller 524, network controller 506, sound controller 520, and general purpose I/O interface 512 is omitted herein for brevity as these features are known.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, define, in part, the scope of the foregoing claim terminology such that no inventive subject matter is dedicated to the public.

The invention claimed is:

1. A swimming pool safety system comprising:

a preservation mechanism having a pool bottom platform having a shape that matches at least a part of a bottom of a swimming pool and lifts a human-sized object from within a designated area of the swimming pool to above a top surface of the swimming pool, the preservation mechanism includes a lifting mechanism connected to the pool bottom platform via a vertical structure;

an underwater detection array having a plurality of sensors disposed under water and configured to detect the human-sized object within the swimming pool and generate detection data when the human-sized object is detected; and a preservation controller that includes a processing circuit configured to actuate the preservation mechanism in response to an actuation signal automatically generated based on the detection data so as to actuate the preservation mechanism and lift the human-sized object above the top surface of the swimming pool, a trigger time and ascension rate of the pool bottom platform corresponding to a detected size of the human-sized object.

2. The swimming pool safety system of claim 1, further comprising:

a manual actuator that when actuated, generates a manual actuation signal that actuates the preservation mechanism to lift the human-sized object above the top surface of the swimming pool.

3. The swimming pool safety system of claim 1, wherein the preservation controller is configured to raise or lower the pool bottom platform attached to the lifting mechanism, in response to control signals, to artificially change the depth of the pool by changing a depth of which the pool bottom platform is deployed.

4. The swimming pool safety system of claim 1, wherein the lifting mechanism provides a motive force to the preservation mechanism through at least one of a mechanical, an electrical, a magnetic, a hydraulic, a pneumatic, a buoyant, and a restorative lifting device.

5. The swimming pool safety system of claim 4, wherein the lifting mechanism is coupled to the vertical structure via at least one of a rack and pinion, a pulley system, a belt drive, and an expansion cylinder coupling device.

6. The swimming pool safety system of claim 5, wherein the preservation mechanism includes another lifting mechanism coupled to another vertical structure so as to allow the preservation mechanism to be implemented in a plurality of pool configurations.

7. The swimming pool safety system of claim 6, wherein the vertical structure has a lower section connected to an upper section via a separable connector that facilitates removal of the lower end of the vertical structure from the upper end of the vertical structure.

8. The swimming pool safety system of claim 7, wherein when the lower section is separated from the upper section and rotated along with the pool bottom platform to an inverted position where the pool bottom platform is positioned above the top surface of the swimming pool so as to shade the swimming pool.

9. The swimming pool safety system of claim 1, wherein the processing circuit calculates, using the detection data, a depth of a deepest part of the human-sized object within the swimming pool using $$\text{Depth} = \frac{(\text{Length}) \times \sin(\text{ref}\theta_1 - \text{lat}\theta_1) \times \sin(\text{ref}\theta_2 - \text{lat}\theta_2)}{\sin[(\text{ref}\theta_1 - \text{lat}\theta_1) + (\text{ref}\theta_2 - \text{lat}\theta_2)]} + \text{Height}$$

where Length is a distance between a first underwater detection sensor and a second underwater detection sensor, and Height is a distance of both the first underwater detection sensor and second underwater detection sensor above a floor of the swimming pool.

10. The swimming pool safety system of claim 1, further comprising:

a plurality of electromagnetic devices disposed on a floor of the swimming pool which when activated, exhibit an attractive force on the pool bottom platform of the preservation mechanism and when deactivated, releases the pool bottom platform of the preservation mechanism, said pool bottom platform having a positive buoyancy.

11. The swimming pool safety system of claim 1, wherein the actuation signal is automatically generated within the preservation controller based on a comparison of the detection data with a set of user defined scenarios that have been stored in a user defined scenario memory.

12. The swimming pool safety system of claim 11, wherein the user defined scenarios include a plurality of categories of human-sized objects including an infant, a toddler, a child, a teenager, and an adult, each category having a plurality of user settable parameters to adjust when an actuation signal is generated and how the preservation mechanism will activate based on the category.

13. The swimming pool safety system of claim 11, wherein the set of user defined scenarios is input to the preservation controller by a touch panel interface.

14. A method of operating a pool safety system, comprising:

generating a detection data with an underwater detector when a human-size object is detected as entering a swimming pool, the underwater detector including a plurality of sensors disposed under water;

generating a scenario based on the detection data, the scenario including both a size and a calculated depth of the human-sized object within the swimming pool along with a total number of detected human-sized objects within the swimming pool;

comparing the scenario to a set of user defined scenarios; and actuating a preservation mechanism and lifting a pool bottom platform above a top surface of the swimming pool if the scenario matches one of the set of user defined scenarios, said lifting being performed according to parameters defined in the one of the set of user defined scenarios, wherein the pool bottom platform having a shape that matches at least a portion of a bottom of the swimming pool, and a trigger time and rate of ascent of the pool bottom platform corresponding to the size of the human-sized object.

15. The method of claim 14, further comprising:

receiving a manual actuation signal from a manual actuator; and actuating the preservation mechanism in response to the receiving so as to lift the pool bottom platform above the top surface of the swimming pool.

16. The method of claim 14, further comprising:

actuating a plurality of lifting mechanisms to simultaneously lift the pool bottom platform above the top surface of the swimming pool based on a set of parameters within the one of the set of user defined scenarios.

17. The method of claim 16, wherein the set of user defined scenarios include a plurality of categories of human-sized objects including an infant, a toddler, a child, a teenager, and an adult, each category having a plurality of user settable parameters to adjust when an actuation signal is generated and how the preservation mechanism will activate based on the category.

18. The method of claim 14, wherein a calculated depth of the human-sized object within the swimming pool is determined using $$\text{Depth} = \frac{(\text{Length}) \times \sin(\text{ref}\theta_1 - \text{lat}\theta_1) \times \sin(\text{ref}\theta_2 - \text{lat}\theta_2)}{\sin[(\text{ref}\theta_1 - \text{lat}\theta_1) + (\text{ref}\theta_2 - \text{lat}\theta_2)]} + \text{Height}$$

where Length is a distance between a first underwater detection sensor and a second underwater detection sensor, and Height is a distance of both the first underwater detection sensor and second underwater detection sensor above a floor of the swimming pool.

* * * * *